US006382631B1

(12) United States Patent
Petermeier et al.

(10) Patent No.: US 6,382,631 B1
(45) **Date of Patent: *May 7, 2002**

(54) SKILL-BASED WATER GUN GAME

(75) Inventors: Norman B. Petermeier, Pleasanton, CA (US); J. Richard Oltmann, Burbank, IL (US); Bryan M. Kelly, Almo, CA (US)

(73) Assignee: RTL Acquition, Inc., Livermore, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/473,509

(22) Filed: Dec. 28, 1999

Related U.S. Application Data

(60) Provisional application No. 60/079,016, filed on Mar. 23, 1998.

(51) Int. Cl.[7] ..... A63B 67/00

(52) U.S. Cl. ..... 273/349; 273/350

(58) Field of Search ..... 273/349, 350, 273/354, 366, 368, 367, 140, 138.5, 457; 446/153, 156, 157; 472/13, 128, 129; 463/64

(56) References Cited

U.S. PATENT DOCUMENTS

| | | | | | |
|---|---|---|---|---|---|
| 1,389,611 | A | * | 9/1921 | Wood et al. | 463/64 |
| 1,526,341 | A | * | 2/1925 | Jeans | 273/349 |
| 1,551,899 | A | * | 9/1925 | Michener | 273/349 |
| 5,704,612 | A | * | 1/1998 | Kelly et al. | 273/402 |
| 5,906,373 | A | * | 5/1999 | Sanders | 273/349 |
| 6,012,722 | A | * | 1/2000 | Petermeier et al. | 273/349 |

* cited by examiner

*Primary Examiner*—Mark S. Graham
(74) *Attorney, Agent, or Firm*—Oppenheimer Wolff & Donnelly LLP

(57) ABSTRACT

Disclosed is a skill-based water gun game. In one embodiment, a water gun game apparatus includes a water tub and a water gun. The water tub has an inner chamber and an outer channel that forms a loop around the inner chamber. The inner chamber and the outer channel are in communication through a front aperture formed in the water tub. The water gun is capable of discharging water towards the water tub. The water gun is used to shoot targets that circulate in the outer channel into the inner channel.

15 Claims, 6 Drawing Sheets

SKILL-BASED WATER GUN GAME

CROSS REFERENCE TO RELATED APPLICATIONS

The present application claims benefit of U.S. Provisional Patent Application No. 60/079,016, entitled "Skill-based Water Gun Game," by Norman B. Petermeier, J. Richard Oltmann, and Bryan M. Kelly, Attorney Docket No. LAZ1P031+, filed Mar. 23, 1998, which is incorporated herein by reference in its entirety.

BACKGROUND OF THE INVENTION

1. Field of the Invention

This invention relates generally to games played in an arcade environment, and more particularly to such games played by shooting water at one or more targets.

2. Description of the Related Art

Games of many types are played in arcade environments. One type of game utilizes water guns to shoot at targets. In conventional water gun games, a player typically aims a water gun at a fixed target such as a hole and pulls the trigger. The trigger pull actuates a flow of water. While maintaining the trigger in such manner, the player holds the water gun as still as possible until a predetermined amount of water has been delivered to the stationary target. The delivery of predetermined amount of water triggers a signal indicating that the object of the game has been achieved such as a popping balloon, water rising in a column, etc. The object of the game is to achieve the task before other players achieve their respective tasks.

It will therefore be appreciated that water gun games are typically played as a race game where more than one player participates in the game at the same time. For example, a plurality of players, each with a water gun, start to shoot water at an assigned target (e.g., holes, etc.) simultaneously. These games are generally designed such that when enough water has been squirted on a target, either a balloon pops or water within a column rises. In this race environment, the player who first pops a balloon or causes a column to rise is declared the winner.

However, these conventional water gun games are not truly skill based games because the success of a player in the games primarily depends on factors other than the ability to hit the target. For example, even when a player hits a target perfectly, other factors such as the water pressure and the volume of water being squirted can make a substantial difference in the outcome of a game. This is because water guns and associated water pumps are not identical for all players. Hence, the selection of a water gun with good water pressure and flow can be critical in these games.

Unfortunately, in these conventional water gun games, the lateral and/or vertical movement of the water gun is generally restricted since these are not truly skill based games. Furthermore, shooting at a stationary target where the success of the game depends largely on the gun itself rather than the skill of a player tends to be simplistic and, as such, can lead to rapid player boredom. This is undesirable in an arcade environment where revenues are directly related to the continuous, repeated use of the games. It is contemplated that an arcade game which enhances the game experience would remain more interesting to players.

In view of the foregoing, what is needed is a water gun game apparatus and method for shooting at a non-stationary target to prolong a player's interest. Further, what is needed is a skill-based water gun game apparatus and method that is less dependent on water gun and water pressure.

SUMMARY OF THE INVENTION

Broadly speaking, the present invention provides a game apparatus and method for shooting a floating target that moves along with a circulating current in a body of water. It should be appreciated that the present invention can be implemented in numerous ways, including as a process, an apparatus, a system, etc. Several inventive embodiments of the present invention are described below.

In one embodiment, a water gun game apparatus includes a water tub and a water gun. The water tub has an inner chamber and an outer channel that forms a loop around the inner chamber. The inner chamber and the outer channel are in communication through a front aperture formed in the water tub. The water gun is capable of discharging water towards the water tub. The water gun is used to shoot targets that circulate in the outer channel to force the targets into the inner channel.

In another embodiment, a water gun game apparatus comprises first and second water tubs and first and second water guns. Each of the first and second water tubs has an inner chamber and an outer channel that forms a loop around the inner chamber. The inner chamber and the outer channel are in communication through a front aperture formed in each of the first and second water tubs. The first and second water guns are capable of discharging water to be directed towards the first and second water tubs, respectively.

In yet another embodiment, a method for operating a water gun game comprises: a) circulating a plurality of targets in an outer channel forming a closed loop around an inner chamber in a water tub; and b) discharging water at the targets to direct the targets into the inner chamber of the water tub.

In still another embodiment, a water gun game apparatus comprises: a) a circulating mechanism for circulating a plurality of targets in an outer channel forming a closed loop around an inner chamber in a water tub; and b) a water discharging mechanism for discharging water at the targets so as to direct the targets into the inner chamber of the water tub.

The water gun game apparatus and method of the present invention provides a plurality of moving targets to prolong a player's interest. A body of circulating water enables the targets to float and circulate in the outer channel of a water tub. By thus providing a dynamic environment, the water gun game of the present invention is less dependent on water gun and water pressure and requires skill in estimating and utilizing lead time. Other aspects and advantages of the invention will become apparent from the following detailed description, taken in conjunction with the accompanying drawings, illustrating by way of example the principles of the invention.

BRIEF DESCRIPTION OF THE DRAWINGS

The present invention will be readily understood by the following detailed description in conjunction with the accompanying drawings, and like reference numerals designate like structural elements.

DETAILED DESCRIPTION OF THE PREFERRED EMBODIMENTS

An invention is described for a skill-based water gun game apparatus and method. It will be obvious, however, to one skilled in the art, that the present invention may be practiced without some or all of these specific details. In other instances, well known process operations have not been described in detail in order not to unnecessarily obscure the present invention.

Figure 1:
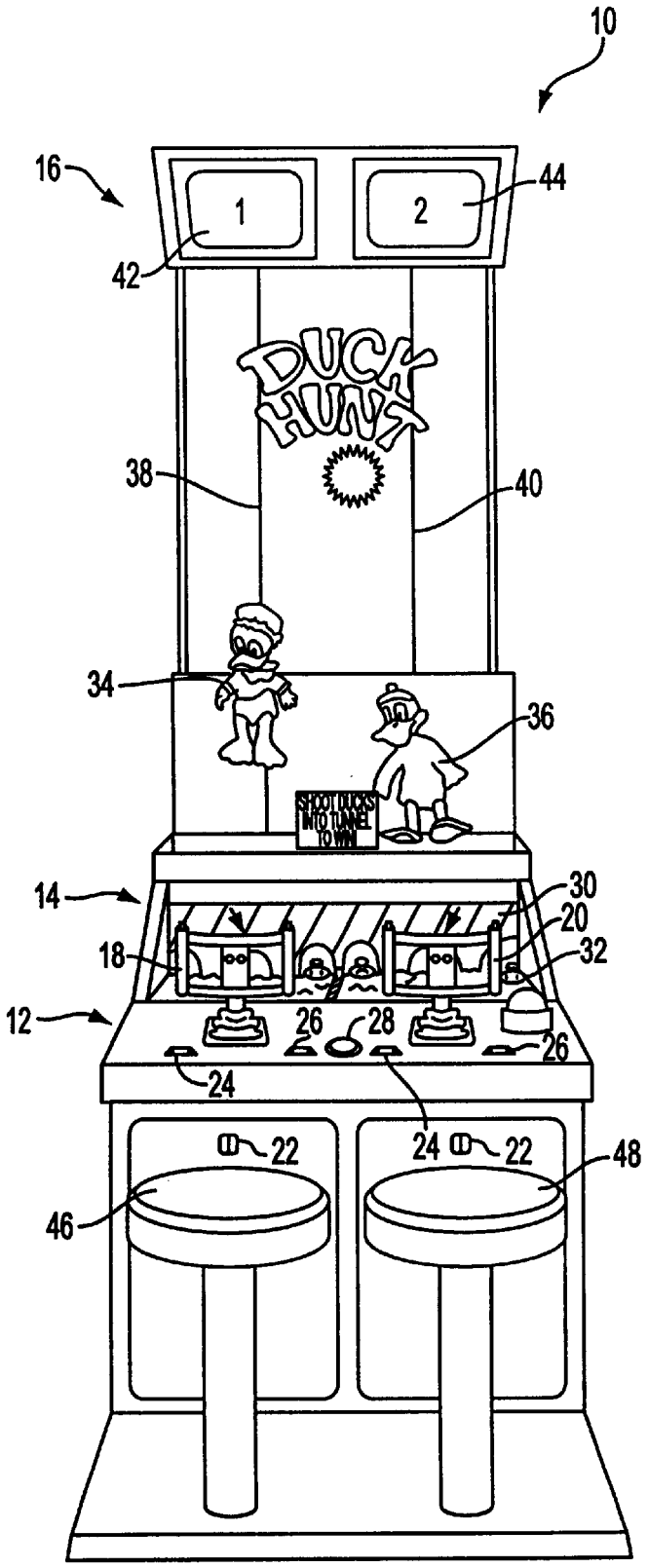
FIG. 1 illustrates a perspective view of a water gun game apparatus in accordance with one embodiment of the present invention.

FIG. 1 illustrates a perspective view of a water gun game apparatus 10 in accordance with one embodiment of the present invention. The water gun game apparatus 10 is arranged as two player stations to accommodate up to two players. Each player station includes a water gun section 12, a target section 14, and a display section 16. In the two player station configuration, one player station includes a water gun 18 and the other player station includes a water gun 20. In an alternative embodiment, a single player version where a player is racing against clock or time would require only one player station including one water gun and one tub. It should also be appreciated that the present invention can be implemented as a multi-player water gun game involving more than two players with each player being assigned a player station or a water gun.

The water gun section 12 includes the water guns 18 and 20 for shooting water onto a corresponding area of the target section 14. The water guns 18 and 20 have both lateral and vertical range of movements to provide a more skill based water gun game than the conventional water gun games. In one embodiment, the water guns 18 and 20 are movable from side-to-side and up-and-down for shooting water onto substantially all areas of the corresponding target section 14. Alternatively, the present invention can also restrict the movement of the water guns to a specified lateral and vertical range.

For each of the water gun stations associated with the water guns 18 and 20, the water gun section 12 also includes a coin deposit slot 22, a red light indicator 24, a yellow light indicator 26, and a green button 28. Seats 46 and 48 are provided for players' comfort. The red light indicator 24 flashes when a player may insert a coin to play the water gun game apparatus 10. When the coin has been inserted into the coin deposit slot 22, the yellow light indicator 26 flashes to indicate that the game can start. The player pushes the green button 28 to start the water game.

The target section 14 includes a scenic cover 30 for covering the inside of the target section 14. As will be discussed below, the target section 14 includes one or more water tubs configured to circulate water in the one or more water tubs. The scenic cover 30 preferably portrays a scene related to water so as to enhance players' visual sensation and enjoyment. The target section 14 is partitioned into two target areas to accommodate two player stations separately. A plurality of targets 32 in the form of toy ducks floating and moving in water are provided in each of the target areas. The scenic cover 30 includes a plurality of holes for shooting the targets into a selected hole. Although the preferred embodiment of the present invention employs one or more water tubs in the target section, those skilled in the art will no doubt recognize that it can also be implemented as a single tub having one or more sections, with each section configured to perform the equivalent functions of a tub.

The display section 16 includes a pair of toy ducks 34 and 36 suspended on a pair of strings or wires 38 and 40, respectively, from a mechanism for indicating the score of the game for the corresponding player station. The score of the game is indicated by an incremental rise of the toy ducks 34 and 36. Initially, the toy ducks 34 and 36 rest at the bottom of the display station 16. Whenever a player at a player station shoots a target 32 into a selected hole, the toy duck associated with the target 32 or the player station rises accordingly. The toy ducks 34 and 36 will reach the top when a predetermined number of targets have been shot into the selected hole of the associated player station. When either of the toy ducks 34 and 36 reaches the top, the associated indicator light 42 or 44 flashes to indicate that the player at the associated player station has won. As will be mentioned below, each of the suspended toy ducks 34 and 36 is coupled to a stepper motor or brushless DC motor for raising the ducks incrementally.

Figure 2A:
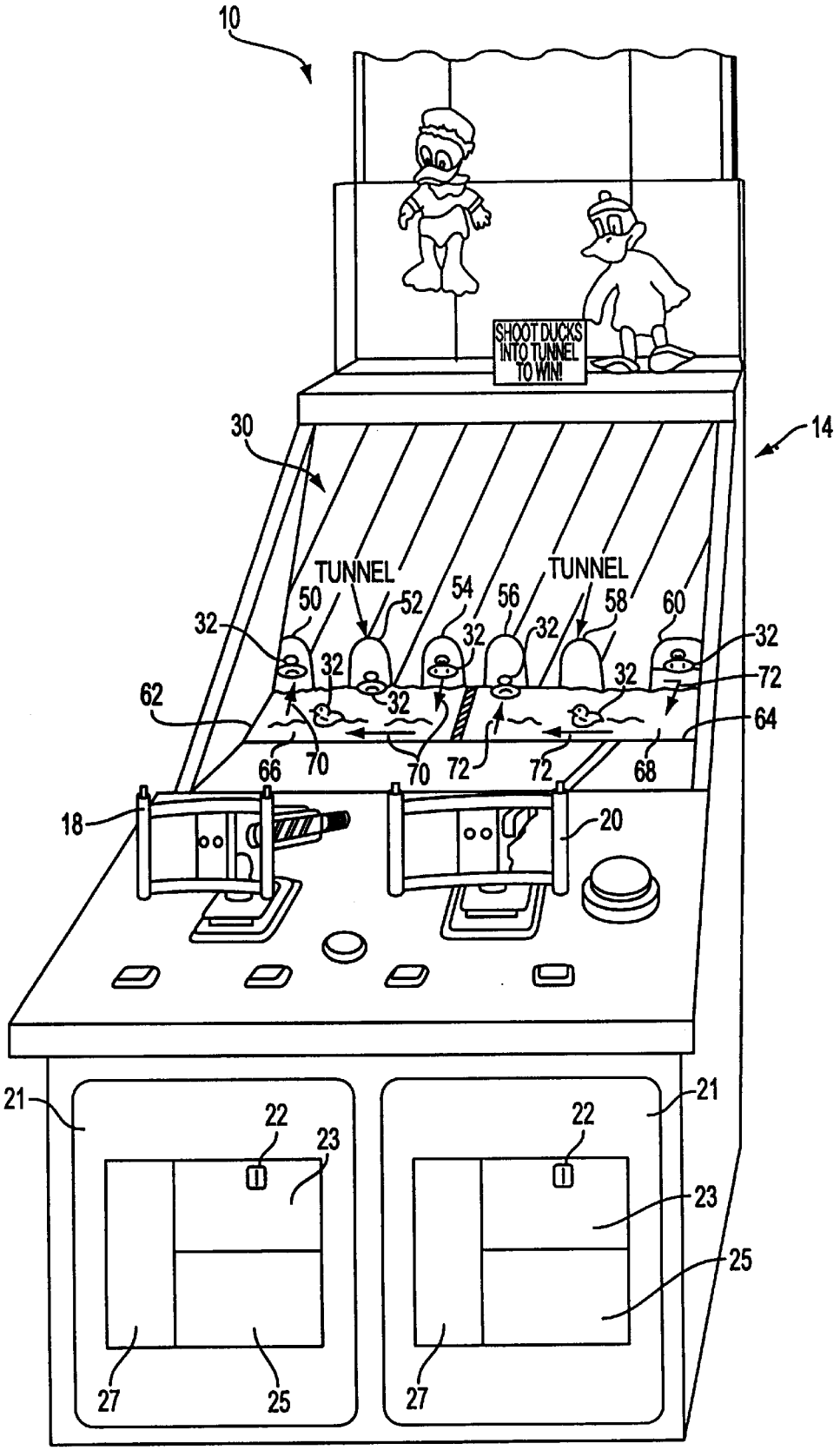
FIG. 2A illustrates a more detailed perspective view of a target section of the water gun game apparatus.

FIG. 2A shows a more detailed perspective view of the target section 14 of the water gun game apparatus 10. The scenic cover 30 includes six holes or apertures 50, 52, 54, 56, 58, and 60. The scenic cover 30 is disposed over two water tubs 62 and 64. The water tub 62 is associated with the water gun 18 and the water tub 64 is associated with the water gun 20. The three holes or apertures 50, 52, and 54 are made on the side of the water tub 62 while the other three holes or apertures 56, 58, and 60 are formed on the side of the water tub 64.

The water tubs 62 and 64 are filled with water 66 and 68, respectively. The water 66 circulates in the water tub 62 substantially in the direction of arrows 70. Similarly, the water 68 circulates in the water tub 64 in the direction of arrows 72. The targets 32 also circulate in the water tubs 62 and 64 in the direction of arrows 70 and 72, respectively. That is, the targets 32 in the water tub 62 come out of the hole or aperture 54 and traverse the target area before exiting into the hole or aperture 50. After the entry and before the exit, a player with the water gun 18 may attempt to shoot the targets into the target hole or aperture 52. The targets 32 in the water tub 64 circulates through the holes or apertures 56 and 60 in a similar manner to enable a player with the water gun 20 to shoot the targets 32 into the center hole 58.

With continuing reference to FIG. 2A, the water gun game apparatus 10 also includes a coin deposit panel 21 for each player or player station. The coin deposit panel 21 includes a deposit slot 22, a coin mechanism 23, a cash box 25, and an optional ticket dispenser 27. The coin deposit slot 22 preferably accepts standard currency coins, game tokens that are often available in an arcade environment, or any other monetary input (e.g., paper bills, debit card, credit card, etc.). The coin mechanism 23 is configured to recognize proper coins, tokens, or other monetary input. The cash box 25 stores deposited coins. Coin deposit slots, cash boxes, and coin mechanisms are well known to those skilled in the art. A game may begin after a coin or token has been inserted by the player. The coin inserted in the coin deposit slot 22 is preferably routed to the cash box 25 or other receptacles. A coin return slot can also be included to return an inserted coin or token to the player in the event the coin becomes trapped in the coin slot mechanism, etc. The optional ticket dispenser 27 preferably dispenses a ticket award to the player based upon the result or score of a game.

Figure 2B:
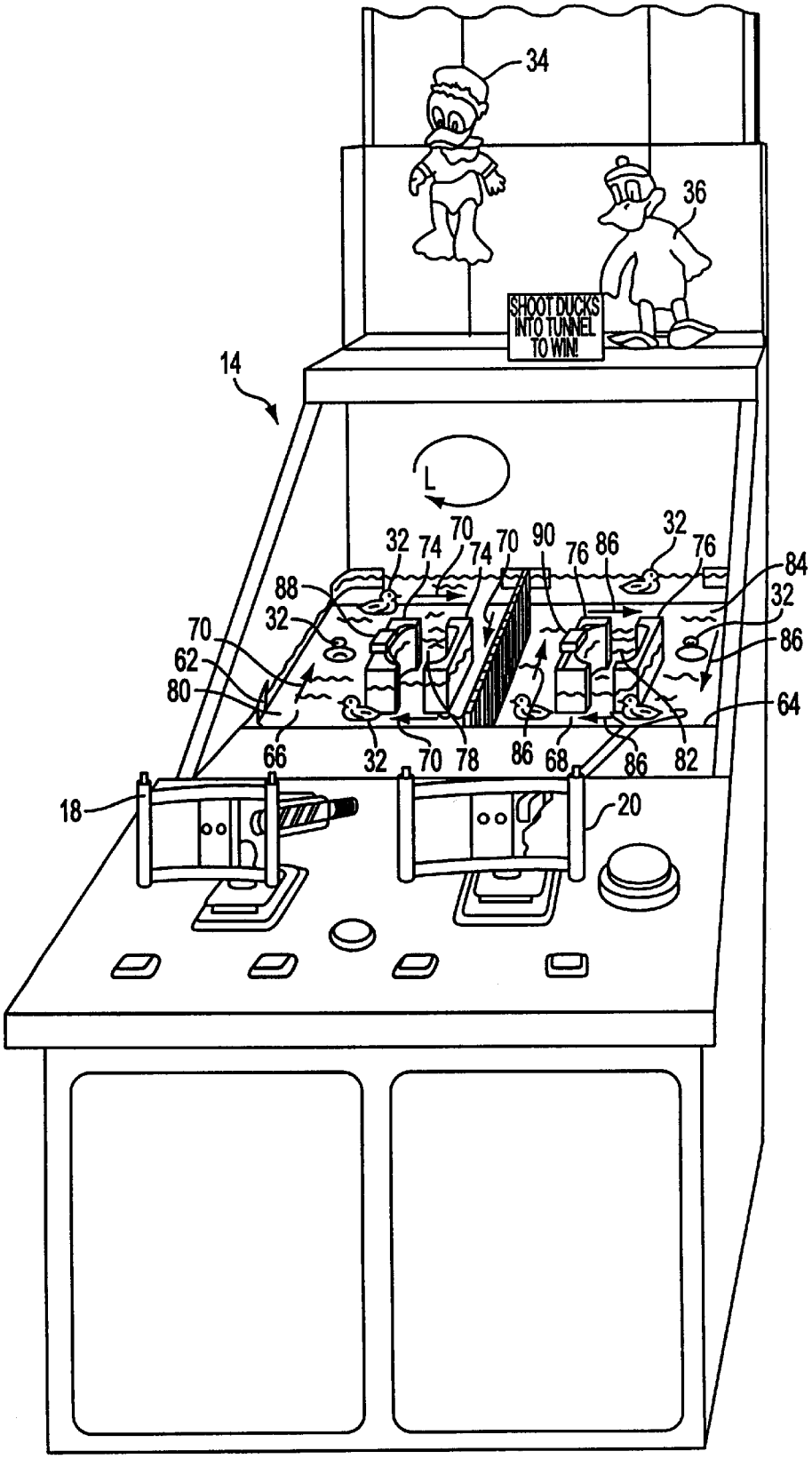
FIG. 2B illustrates a perspective view of the water gun game apparatus without a scenic cover to depict a detailed view of a pair of water tubs.

FIG. 2B illustrates a perspective view of the water gun game apparatus 10 without the scenic cover 30 to show a more detailed view of the water tubs 62 and 64. The water tubs 62 and 64 include wall structures 74 and 76, respectively. The wall structure 74 partitions the water tub 62 into an inner chamber 78 and an outer channel 80 that defines a loop L around the inner chamber 78. The water 66 and the targets 32 in the water tub 62 circulate in the outer channel 80 as indicated by arrows 70. Similarly, the wall structure 76 partitions the water tub 64 into an inner chamber 82 and an outer channel 84 forming a loop around the inner chamber 82. The water 68 and the targets 32 in the water tub 64 circulate in the outer channel 84 as indicated by arrows 72.

Sensors 88 and 90, are mounted on the wall structures 74 and 76, respectively, for detecting and counting the targets in the inner chambers 78 and 82, respectively. For example, when a player with the water gun 18 shoots a target 32 into the inner chamber 78, the sensor 88 detects the target 32 and accumulates the number of targets 32 that have been detected in the inner chamber 78. The toy duck 34 or 36 rises in response to each target that has been thus detected. In an alternative embodiment, the present invention may utilize colored targets where the sensors 88 and 90 detect targets of specified color or colors in the inner chamber. Although the present invention utilizes sensors mounted on wall structures, it should be appreciated that the sensors can also be disposed on other parts of the target section 14 to detect targets in the inner chamber area.

Figure 3A:
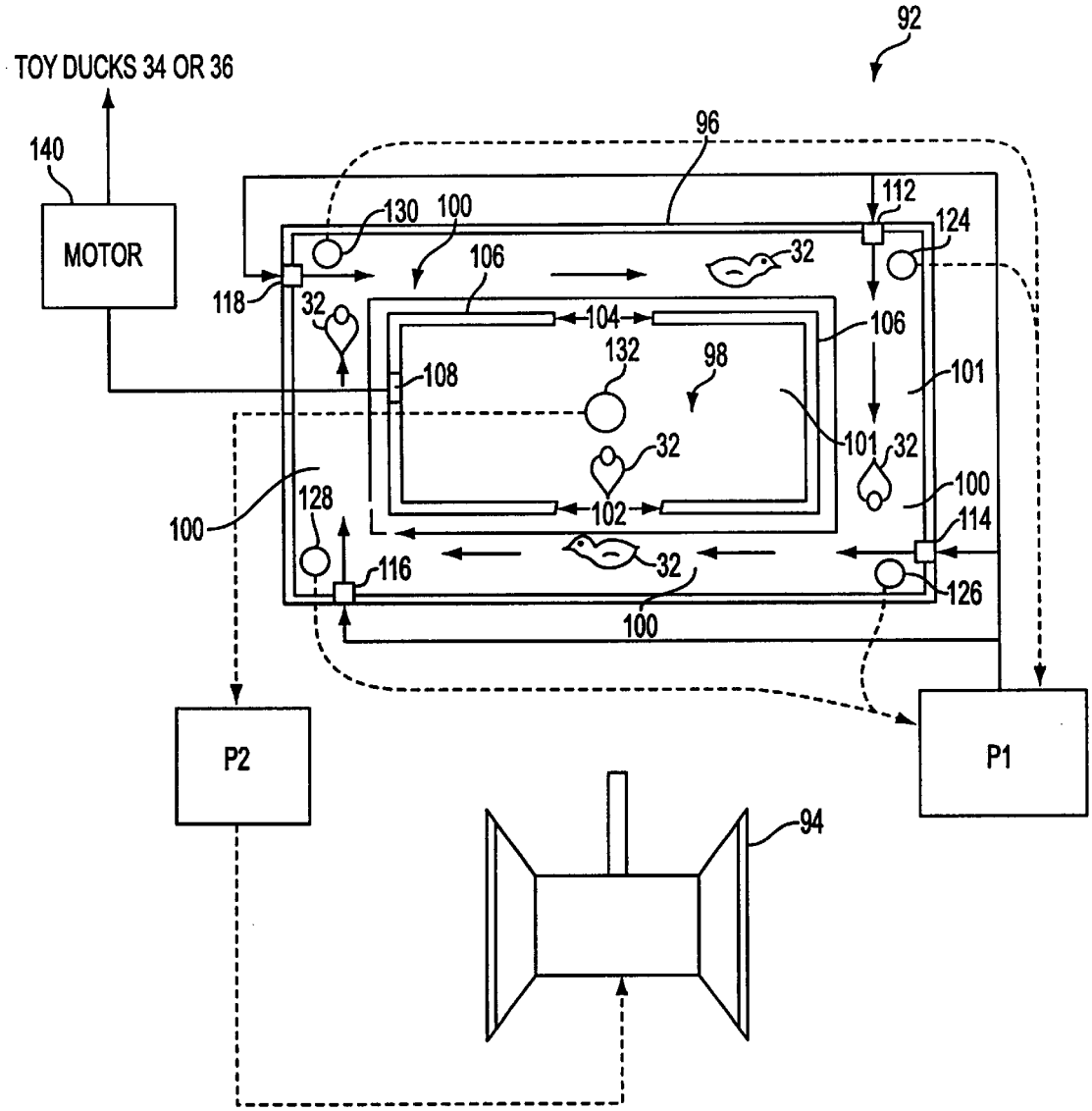
FIG. 3A illustrates a top plan view diagram of a water gun game apparatus in accordance with one embodiment of the present invention.

In accordance with one aspect of the present invention, FIG. 3A illustrates a top plan view diagram of a water gun game apparatus 92. The game apparatus 92 includes a water gun 94 and a water tub 96. The water tub 96 is partitioned into an inner chamber 98 and an outer channel 100 that defines an outer loop L forming a pathway for a circulating current in a body of water 101. The inner chamber 98 and the outer channel 100 are in communication through a front aperture 102 and a back aperture 104. The front aperture 102 faces the water gun 94. The front and back apertures 102 and 104 are large enough to allow the targets 32 to pass through, preferably one at a time.

Preferably, a wall structure 106 partitions the water tub 96 into the inner chamber 98 and the outer channel 100. A sensor 108 is mounted on the wall structure 106 to detect the presence of a target 32 in the inner chamber 98. The sensors for detecting the presence and color of an object are known in the art and are described, for example, in U.S. Pat. No. 5,704,612, of Kelly et al., entitled "ARCADE GAME WITH COLOR SENSING APPARATUS," which is incorporated herein by reference in its entirety.

The water tub 96 is configured to hold a circulating body of water 101. Specifically, the water tub 96 includes a plurality of water jets 112, 114, 116, and 118 (e.g., water pipes, nozzles, etc.) to force water in a specified direction. The water jets 112, 114, 116, and 118 are strategically mounted on the wall of the water tub 96 so as to force water to circulate along the outer channel 100 in a closed loop L fashion.

The water tub 96 also includes a plurality of drain holes 124, 126, 128, and 130 in the outer channel 100 to supply water to the water jets 112, 114, 116, and 118. Preferably, the drain holes 124, 126, 128, and 130 are formed at the bottom of the water tub 96. A water pump P1 is connected between the drain holes 124, 126, 128, and 130 and the water jets 112, 114, 116, and 118. The water pump P pumps the drained water from the drain holes 124, 126, 128, and 130 into the water jets 112, 114, 116, and 118. In this manner, the water pump P1 keeps the water level in the water tub 96 at an equilibrium and creates a current in the water as indicated by the closed loop L.

In this water tub configuration, one or more floating objects are provided in the water tub 96 as targets 32. The targets 32 are adapted to float and circulate in the circulating body of water 101 in the water tub 96 in response to the water flow generated by the water jets 112, 114, 116, and 118. Hence, the floating and circulating targets 32 function as moving targets. In a preferred embodiment, the targets 32 take the shape of objects related to water such as ducks, and the like.

With reference still to FIG. 3A, the water tub 96 is coupled to a water gun 94 via a water pump P2. T he water tub 96 has a drain hole 132 formed in the inner chamber 98. The water pump P2 is coupled to the drain hole 132 to drain the water from the inner chamber 98 and pump the drained water into the water gun 94. The water pump P2 thus serves to supply water to the water gun 94. Preferably, the drain hole 132 is formed in the center of the inner chamber 98 in the water tub 96. Although the present invention employs the water pump P2 and the drain hole 132 to supply water to the water gun 94, those skilled in the art will appreciate that water can also be supplied to the water gun through other drain holes and/or in combination with the water pump P1.

An object of the water gun game apparatus 92 is to shoot the targets 32 into the inner chamber 98 of the water tub 96. Initially, the water pump P1 operates to circulate the body of water 101 in the outer channel 100 by drawing the water from the drain holes 124, 126, 128, and 130 and pumping the water back into the outer channel 100 via the water jets 112, 114, 116, and 118. This pump action causes the water to circulate along the outer channel 100 in the water tub 96. In response, the targets 32 also circulate in the water along the outer channel 100 in the water tub 96. A player uses the water gun 94 to discharge water (i.e., shoot) onto the targets 32 so as to force the targets into the inner chamber 98. Since the targets 32 are moving along with the circulating water, the player obtains a better result by shooting at a target based on the lead time of the target to reach the front aperture 102. By thus providing circulating targets 32, the water gun game of the present invention tests the shooting skills of the player. It should be appreciated that the water gun game apparatus 92 is a single player station and as such, two water gun game apparatus 92 can be combined to form the water gun game apparatus 10 of FIG. 1.

In one embodiment, the targets 32 may have different colors so that the sensor 106 detects and accumulates the number of targets according to the color of the target detected in the inner chamber 98. Different colors can be used in multi-player environment where each player is assigned a color of targets to shoot at. Also, targets of a specified color may be designated as non-target objects while targets having other colors can be shot at as proper targets. Thus, a player can be challenged to correctly distinguish between the proper and improper targets.

When a target 32 is forced into the inner chamber 98, the sensor 108 detects the presence of the target 32 in the inner chamber 98 and counts the number of the targets 32 detected in the inner chamber 98. In an alternate embodiment, the sensor 108 detects the color of the targets 32 in the inner chamber and counts the number of the targets detected in the inner chamber.

The sensor 108 is coupled to a stepper motor 140 for lifting, for example, the above mentioned toy ducks 34 and/or 36. Whenever the sensor 108 detects a target 32 or a target 32 of a specified color in the inner chamber 98, the sensor 108 activates the stepper motor 140, which lifts a toy duck by a specified height or increment at a time. When two players are playing, whoever makes his or her corresponding ducks rise to a predetermined height first wins. That is, the game ends when a player has forced a predetermined number of targets 32 into the inner chamber 98 thereby raising the toy duck to the top. By thus accumulating the number of targets 32 in the inner chamber 98, the present invention can determine and show the accumulated number or a corresponding score to the player.

After a target 32 has been forced into the inner chamber 98, the target 32 is directed back out to the outer channel 100 through the back aperture 104. The target 32 thus rejoins other targets 32 in circulating along the outer channel 100. In order to lead the target 32 back out to the outer channel 100 through the back aperture 104, the present invention may provide one or more jets and drains in the inner chamber 98. Those skilled in the art will no doubt recognize that these jets and drains can be coupled to the water pump P1 or an independent water pump that functions exclusively in conjunction with these jets and drains.

Figure 3B:
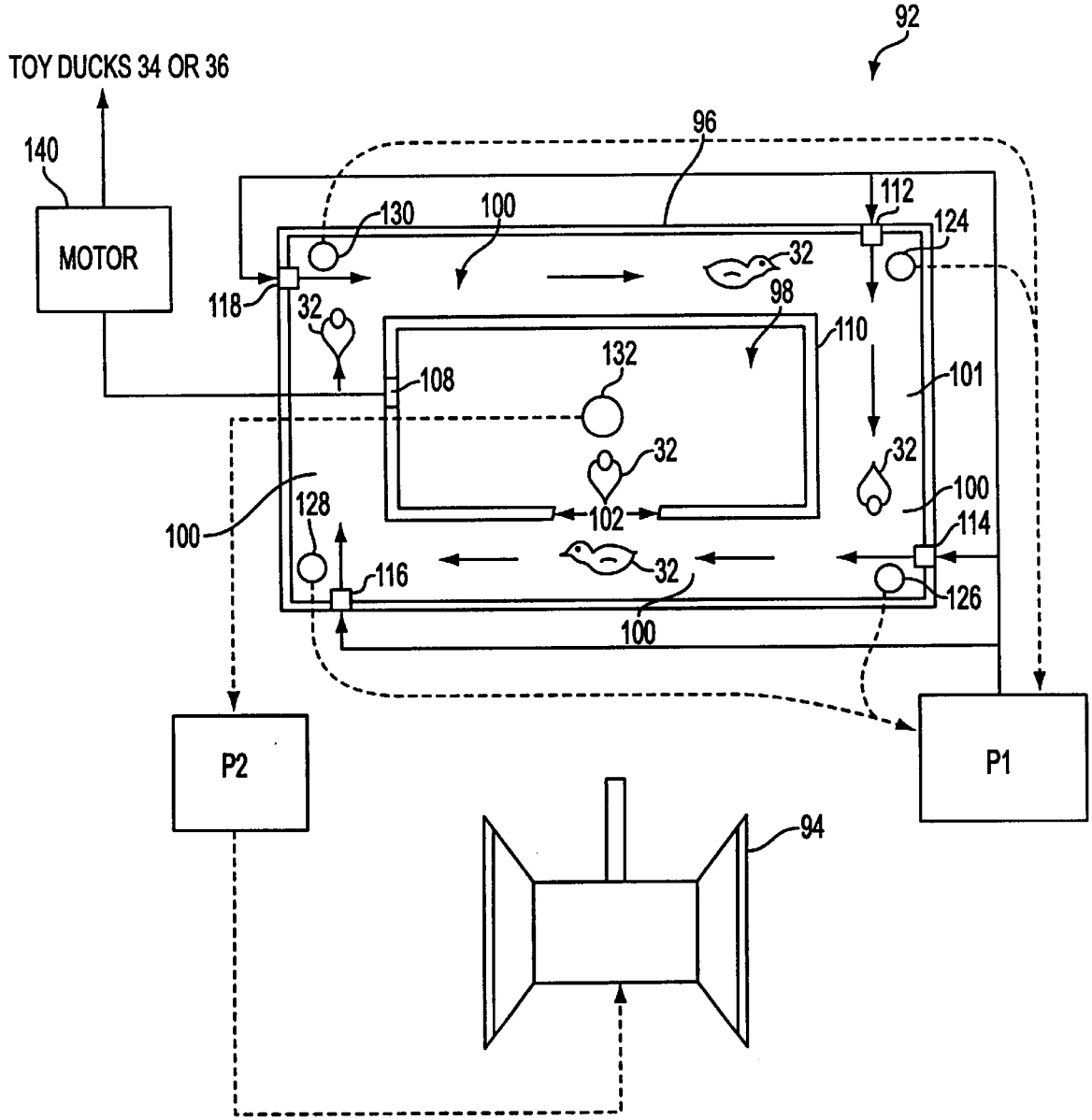
FIG. 3B illustrates a water gun game apparatus that accumulates targets in an inner chamber in accordance with another aspect of the present invention.

In another embodiment of the present invention, the targets 32 accumulate in the inner chamber 98 instead of passing out through the back aperture 104. FIG. 3B illustrates an alternative embodiment of the water gun game apparatus 92 that accumulates the targets in the inner chamber 98 of the water tub 96. In this configuration, the water tub 96 is partitioned into the inner chamber 98 and an outer channel 100 that defines an outer loop pathway for a circulating body of water 101. The inner chamber 98 and the outer channel 100 are in communication through the front aperture 102 only. The front aperture 102 faces the water gun 94 and is large enough to allow a target 32 to pass through. When a player shoots a target 32 into the inner chamber 152 through the front aperture 102, the sensor 108 detects and counts the target 32 in the inner chamber 98. In this arrangement, the targets 32 continue to accumulate in the inner chamber 152 until a predetermined time elapses or a player shoots all targets 32 into the inner chamber 152.

With reference to FIG. 3B, it should be noted that the water tub 96 does not include additional jets and drains for leading the targets back out to the outer channel 100 since the targets 32 are accumulated in the inner chamber 98. It should also be appreciated that the present invention can be implemented as a one player game or as a multi-player water race gun game using any of the above described tubs in a single or multi-tub configurations.

Figure 4:
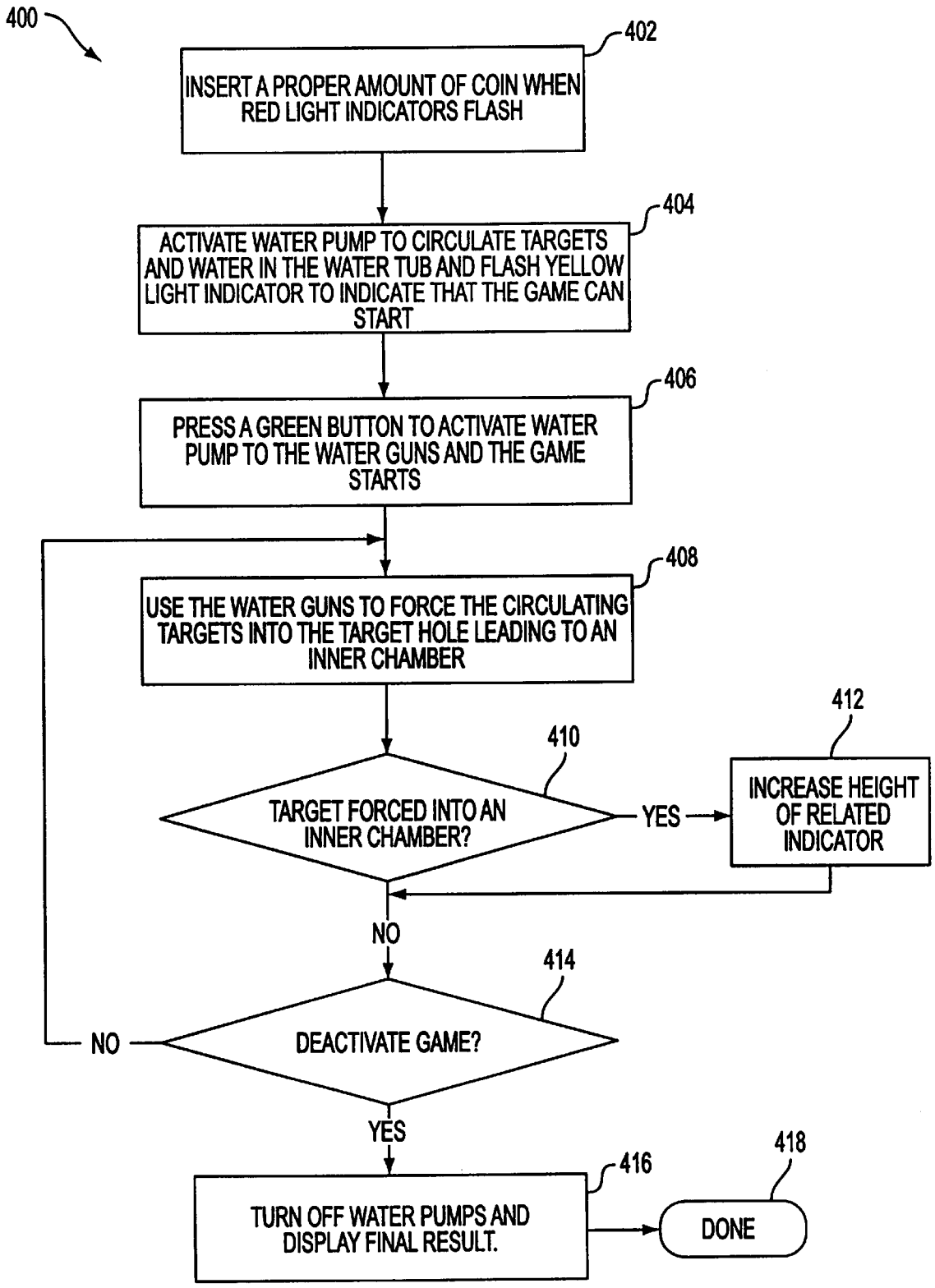
FIG. 4 illustrates a flow diagram of the operations involved in operating the water gun game apparatus in accordance with one embodiment of the present invention.

FIG. 4 illustrates a flow diagram of a method 400 in operating the water gun game apparatus 10 in accordance with one embodiment of the present invention. In operation 402, when the red light indicators 24 flash, a player A and a player B inserts a coin into the respective coin slots 22. Then in operation 404, when proper amount of coin has been inserted, a water pump (e.g., water pump P1) is activated to circulate water and the targets 32 in the water tubs 62 and 64, and the yellow light indicators 26 flash to indicate that the water game can start. In operation 406, the players then press the green button 28 to activate a water pump (e.g., water pump P2) that is coupled to the water guns 18 and 20.

In operation 408, the players use the water guns 18 and 20 to force the circulating targets 32 into the target hole or aperture 52 and 58, respectively, which lead to the inner chambers 78 and 82 in the water tubs 62 and 64, respectively. Since the targets 32 are moving with the circulating water, shooting the targets when they are in front of the target hole or aperture 52 and 58 will generally not force the targets into the inner chambers 78 and 82. This is because when a water gun is discharged at that moment, the targets 32 will have moved past the target hole or aperture 52 and 58 when the water reaches the targets 32. Accordingly, the player who is better able to estimate and utilize lead time of the targets 32 in reaching the target hole or apertures 52 and 58 will typically obtain better scores.

In operation 410, it is determined whether a target has been forced into an inner chamber. If so, the height of a related indicator object (e.g., toy ducks) is increased or raised in operation 412. The method 400 then proceeds from operations 410 or 412 to operation 414 where it is determined whether to deactivate the game. Preferably, the game deactivates when a predetermined time has elapsed or when a player has attained the goal of the game (e.g., indicator object reaches the top). If the game is not to be deactivated, the method 400 proceeds to operation 408 where the players continue to use the water guns to force the targets into the inner chambers. On the other hand, if the game is to be deactivated, the method 400 proceeds to operation 416. In operation 416, the water pumps are turned off and the final result is displayed. The game then terminates in operation 418.

Although the foregoing invention has been described in some detail for purposes of clarity of understanding, it will be apparent that certain changes and modifications may be practiced within the scope of the appended claims. Accordingly, the present embodiments are to be considered as illustrative and not restrictive, and the invention is not to be limited to the details given herein, but may be modified within the scope and equivalents of the appended claims.

What is claimed is:

1. A water gun game apparatus comprising:

a water tub having an inner region and an outer region, the inner region and the outer region being in communication through an aperture formed in a wall portion separating said inner region from said outer region, the water tub including at least one drain hole;

a water gun capable of discharging water towards the water tub; and a first pump having an inlet coupled to said drain hole for drawing water from the water tub; and at least one jet coupled to an outlet of said first pump for circulating water along the outer region in the water tub.

2. The apparatus as recited in claim 1, wherein said drain hole is a first drain hole and wherein the water tub includes a second drain hole, the apparatus further comprising a second pump having an inlet coupled to said second drain hole and an outlet coupled to said water gun.

3. The apparatus as recited in claim 2, wherein the second drain hole is formed in the inner region of the water tub.

4. The apparatus as recited in claim 1, further comprising a plurality of targets adapted to circulate along the outer region in response to the jets.

5. The apparatus as recited in claim 4, wherein the targets are capable of floating in water.

6. The apparatus as recited in claim 5, wherein the water gun is capable of directing water at the targets so as to force the targets into the inner region through the aperture.

7. The apparatus as recited in claim 1, wherein the drain hole is formed in the outer region of the water tub.

8. The apparatus as recited in claim 1, wherein the inner region and the outer region of the water tub are in communication via a second aperture that is arranged to provide a passageway through the inner region.

9. The water gun game apparatus as recited in claim 1, wherein the wall portion separating said inner region from said outer region includes a wall structure for partitioning the water tub into the inner region and the outer region.

10. A water gun game apparatus comprising:

first and second water tubs, each water tub having an inner region and an outer region, the inner region and the outer region being in communication through an aperture formed in a wall portion separating said inner region and said outer region, of the first and second water tubs;

the first tub including at least one first drain hole and the second tub including at least one second drain hole;

first and second water guns capable of discharging water towards the first and second water tub, respectively;

a first pump having an inlet coupled to said first drain hole for drawing water from the first water tub; and at least one first jet coupled to an outlet of said first pump for circulating water along the outer region in the first water tub; and a second pump having an inlet coupled to said second drain hole for drawing water from the second water tub; and at least one second jet coupled to an outlet of said second pump for circulating water along the outer region in the second water tub.

11. A method for operating a game by directing a circulating target into a designated area, the method comprising:

circulating a plurality of targets in an outer region, said outer region in communication with an inner region via an aperture in a water tub; and aiming a water jet that is directing water at the targets to force the targets into the inner region through the aperture.

12. The method as recited in claim 11 wherein the target circulating further comprises:

circulating a body of water in the outer region of the water tub.

13. The method as recited in claim 12 wherein the act of circulating a plurality of targets further comprises:

draining a first portion of the body of water from the water tub; and pumping the first portion of the body of water from the water tub back into the water tub through at least one jet, wherein the body of water circulates substantially in the direction of the first portion of the body of water.

14. The method as recited in claim 11 further comprising:

detecting the targets in the inner region of the water tub; and displaying a score corresponding to the detected targets.

15. A water gun game apparatus comprising:

a water tub having an inner region defined by a partition having an aperture and an outer region having at least a portion adjacent to said aperture, the inner region and the outer region being in communication through said aperture;

a quantity of water in said water tub;

a movable target located in said outer region; and a steerable water jet capable of directing a stream of water, whereby the stream of water can be directed at the target such that the stream of water may force the target to the aperture.

* * * * *